US006916276B1

(12) United States Patent
Robinson

(10) Patent No.: US 6,916,276 B1
(45) Date of Patent: Jul. 12, 2005

(54) BALANCE BOARD

(76) Inventor: Steven Robinson, 420 Megan Dr., Cantonment, FL (US) 32533

( * ) Notice: Subject to any disclaimer, the term of this patent is extended or adjusted under 35 U.S.C. 154(b) by 48 days.

(21) Appl. No.: 10/687,169

(22) Filed: Oct. 17, 2003

(51) Int. Cl.[7] ..... A63B 71/00

(52) U.S. Cl. ..... 482/51; 482/80; 482/147; 482/34

(58) Field of Search ..... 482/51, 79, 80, 482/142, 146, 148, 34; D21/688, 689; 446/396

(56) References Cited

U.S. PATENT DOCUMENTS

| | | | |
|---|---|---|---|
| 2,764,411 | A | 9/1956 | Washburn, Jr. |
| 2,829,891 | A | 4/1958 | Ludwig |
| 2,829,892 | A | 4/1958 | Ludwig |
| 3,389,910 | A | 6/1968 | Kanzler, Jer |
| 3,488,049 | A | 1/1970 | Sasser, Jr. |
| 3,895,794 | A | 7/1975 | England |
| D237,813 | S | 11/1975 | England |
| 4,191,371 | A | 3/1980 | Armer, Jr. |
| 4,505,477 | A | 3/1985 | Wilkinson |
| 4,601,469 | A | 7/1986 | Sasser, Jr. |
| 4,826,159 | A | 5/1989 | Hersey |
| 4,911,440 | A | 3/1990 | Hyman et al. |
| 5,152,691 | A | 10/1992 | Moscarello |
| 5,190,506 | A | 3/1993 | Zubik et al. |
| D376,629 | S | 12/1996 | Mounts et al. |
| 6,017,297 | A | 1/2000 | Collins |

*Primary Examiner*—Justine R. Yu
*Assistant Examiner*—Tam Nguyen
(74) *Attorney, Agent, or Firm*—Peter Loffler

(57) ABSTRACT

A balance board for exercising, sports training, recreation and the like, uses a board member that rides along a roller along either the central longitudinal axis of the board member or along the central vertical axis of the board member. Stop members are removably attached to the board member for limiting the range or ride of the board member with respect to the roller on either axis and to further selectively vary the distance of travel of the board member when it is traveling on its longitudinal axis.

18 Claims, 5 Drawing Sheets

BALANCE BOARD

BACKGROUND OF THE INVENTION

1. Field of the Invention

The present invention relates to a balance board that is used for exercise, recreation, and training for such sports as surfing and amusement wherein the distance that can be traveled along on the roller of the balance board is selectively adjustable by the user.

2. Background of the Prior Art

Balance boards have been in use for a long period of time. Essentially, these devices provide a board member that sits atop a roller in some fashion and a user places his feet on the top surface of the board and has the board travel back and forth along the roller in order to develop balance skills as well as develop leg muscles. Such devices, which come in various configurations, have found particular favor amongst surfing enthusiasts. As balance boards simulate many of the balancing acts that must be performed on a surf board, balance boards provide an ideal platform upon which to practice and hone such skills while land side, allowing the surfer to be able to develop surfing skills even when not at the shoreline.

Although the balance boards expand the window of opportunity for surfing practice, some boards are limited in functionality in that they provide only a single range of travel for the board with respect to the roller. As an experienced surfer desires to be able to control a surf board across a wide range of back and forth distances, the single range of motion limits the surfer's ability to develop and refine such skills. Additionally, such a single range of motion does not give a user the ability to effectively practice side to side control of the board.

In order to overcome this limit in range of travel, balance boards have been proposed that allow for variance in the travel distance of the board with respect to the roller and/or the axis of travel of the board along the roller. However, the prior art devices tend to be unduly complex in design and construction making such devices relatively expensive to manufacture and to purchase by the public. Additionally, many prior art devices are cumbersome in changing from one range of travel to another or from one axis of travel to the other. This results in a time-consuming process of changeover, making the balance board less desirable to use to its full ability.

Therefore, there exists a need in the art for a balance board that has a variable range of travel with respect to the roller as well as having multiple axis of travel of the board along the roller, which balance board overcomes the shortcomings found in the art. Such a balance board must be relatively simple in design and construction such that it is relatively easy and inexpensive to manufacture so as not to make the balance board cost prohibitive to the consuming public. The balance board must allow for a rapid changeover from one range of travel to another or from one axis of travel to the other so as to make the device versatile and make the changeover feature easy to use by the user.

SUMMARY OF THE INVENTION

The balance board of the present invention addresses the aforementioned needs in the art. The balance board has a variable range of travel with respect to its roller as well as having multiple axis of travel of the board along the roller. The balance board is relatively simple in design and construction such that it is relatively easy and inexpensive to manufacture thereby making the balance board cost attractive to the consuming public. The balance board allows for a rapid changeover from one range of travel to another and from one axis of travel to the other making the device versatile and making the changeover feature easy to use by the user.

The balance board of the present invention is comprised of a cylindrical roller. A board member sits atop the roller and reciprocatively rides on the roller either along a central longitudinal axis of the board member or along a central latitudinal axis of the board member. A pair of stop members are removably attached to the board member for limiting the range of ride of the board member along either the longitudinal axis or along the latitudinal axis. The stops are attached to the board equidistant and on opposed sides of the latitudinal axis in order to limit the ride of the board member along the longitudinal axis and are attached to the board member equidistant and on opposed sides of the longitudinal axis in order to limit the ride of the board member along the latitudinal axis. The distance between each stop member and the latitudinal axis is variable so that the range of ride of the board member along the roller is variable.

BRIEF DESCRIPTION OF THE DRAWINGS

Similar reference numerals refer to similar parts throughout the several views of the drawings.

DESCRIPTION OF THE PREFERRED EMBODIMENT

Figure 1:
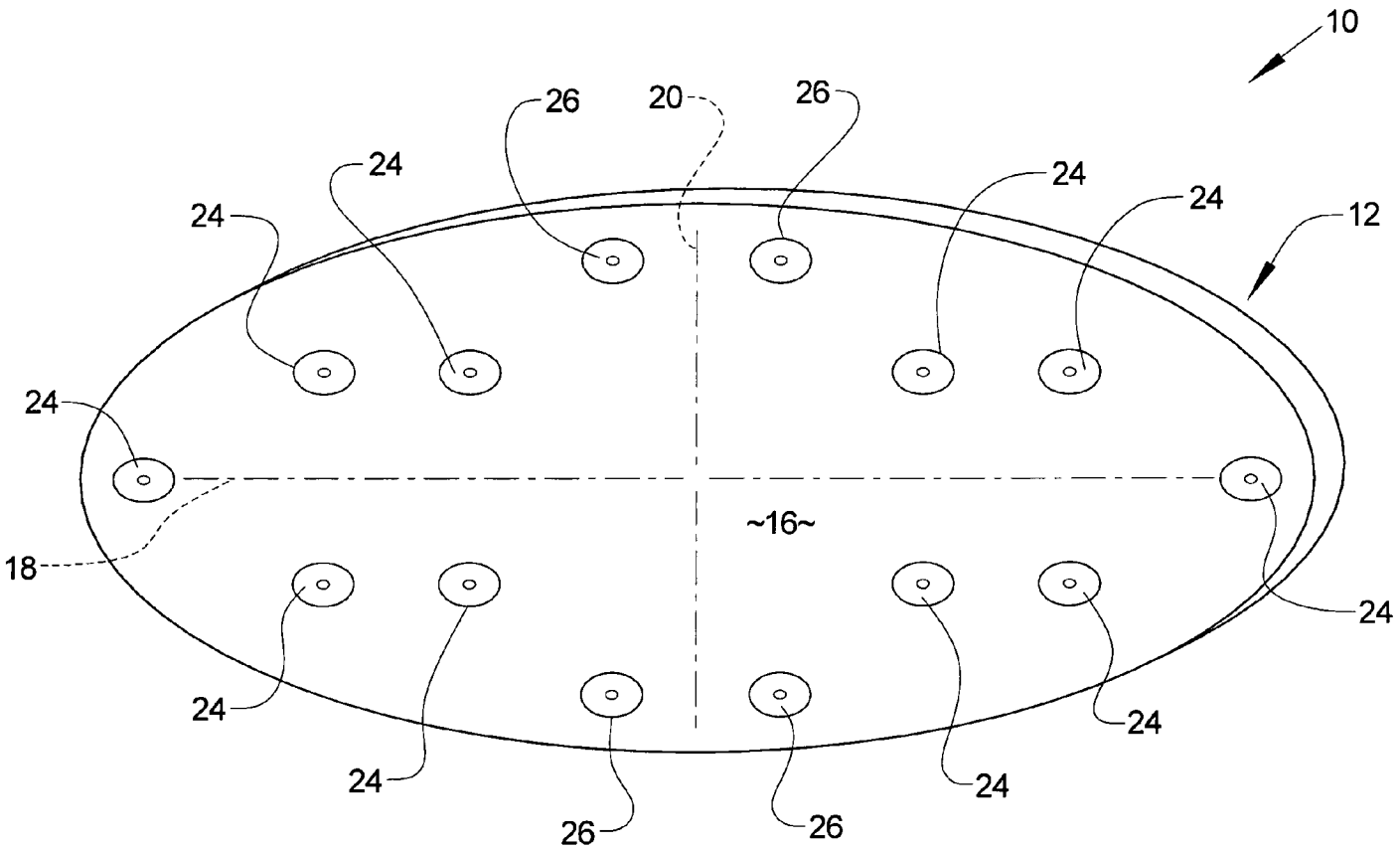
FIG. 1 is a lower perspective view of the balance board of the present invention.

Referring now to the drawings, it is seen that the balance board of the present invention, generally denoted by reference numeral 10, is comprised of a board member 12 that has an upper surface 14 and a lower surface 16. The board; member 12 has a centrally disposed longitudinal axis 18 and a central latitudinal axis 20 that is normal to the longitudinal axis 18. The board member 12, which can have any appropriate shape such as the illustrated oval shape, is made from any appropriate material such as wood, plastic, aluminum, etc. A cylindrical roller 22 is provided such that the lower surface 16 of the board member 12 sits atop the roller 22 and rides along the roller 22. As best seen in FIG. 1, a first set of attachment point pairs 24 are located on the lower surface 16 of the board member 12. As seen each corresponding pair 24 is located equidistant and on opposite sides of the latitudinal axis 20 and each pair 24 is located a distance that is different relative to other pairs 24, and each one of each pair 24 may be a single attachment point that is located directly on the longitudinal axis 18, or each one of each pair 24 may be individual two points such that they are also located equidistant and on opposite sides of the longitudinal axis 18. A second set of attachment point pairs 26 are located on the lower surface 16 of the board member 12 equidistant and on opposite sides of the longitudinal axis 18. In similar fashion to the first attachment point pairs 24, each one of each pair 26 may be a single attachment point that is located directly on the latitudinal axis 20, or each one of each pair 26 may be individual two points such that they are also located equidistant and on opposite sides of the latitudinal axis 20, as illustrated in the drawings.

A pair of stop members 28 is removably attached to the lower surface 16 of the balance board 12 at either the first pair of attachment points 24 or at the second pair of attachment points 26. The number of attachment points comprising the particular pair, 24 or 26, being used determines the number of individual stop members 28 that comprise the pair.

Figure 2:
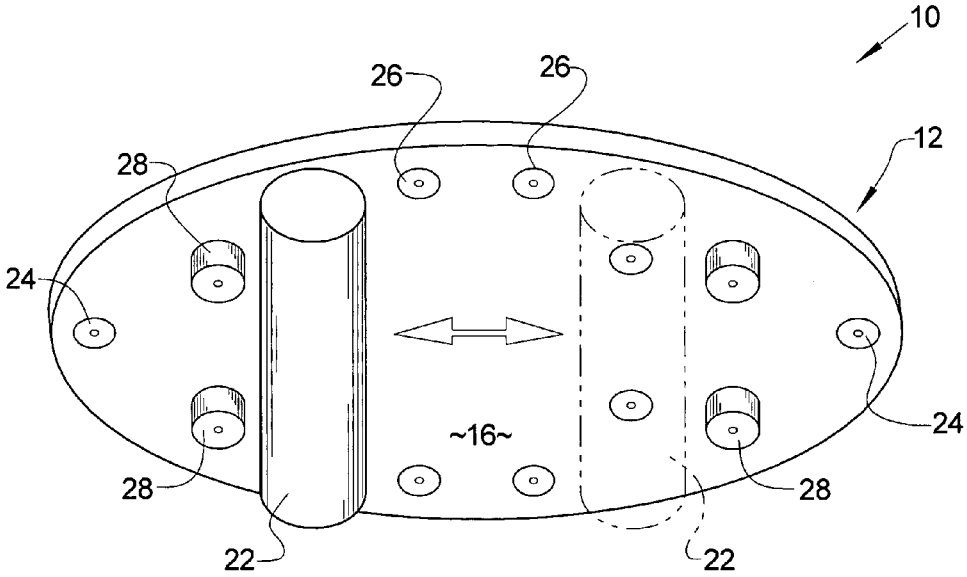
FIG. 2 is a lower perspective view of the balance board of the present invention illustrating one range of travel with respect to a longitudinal axis of travel.
Figure 4:
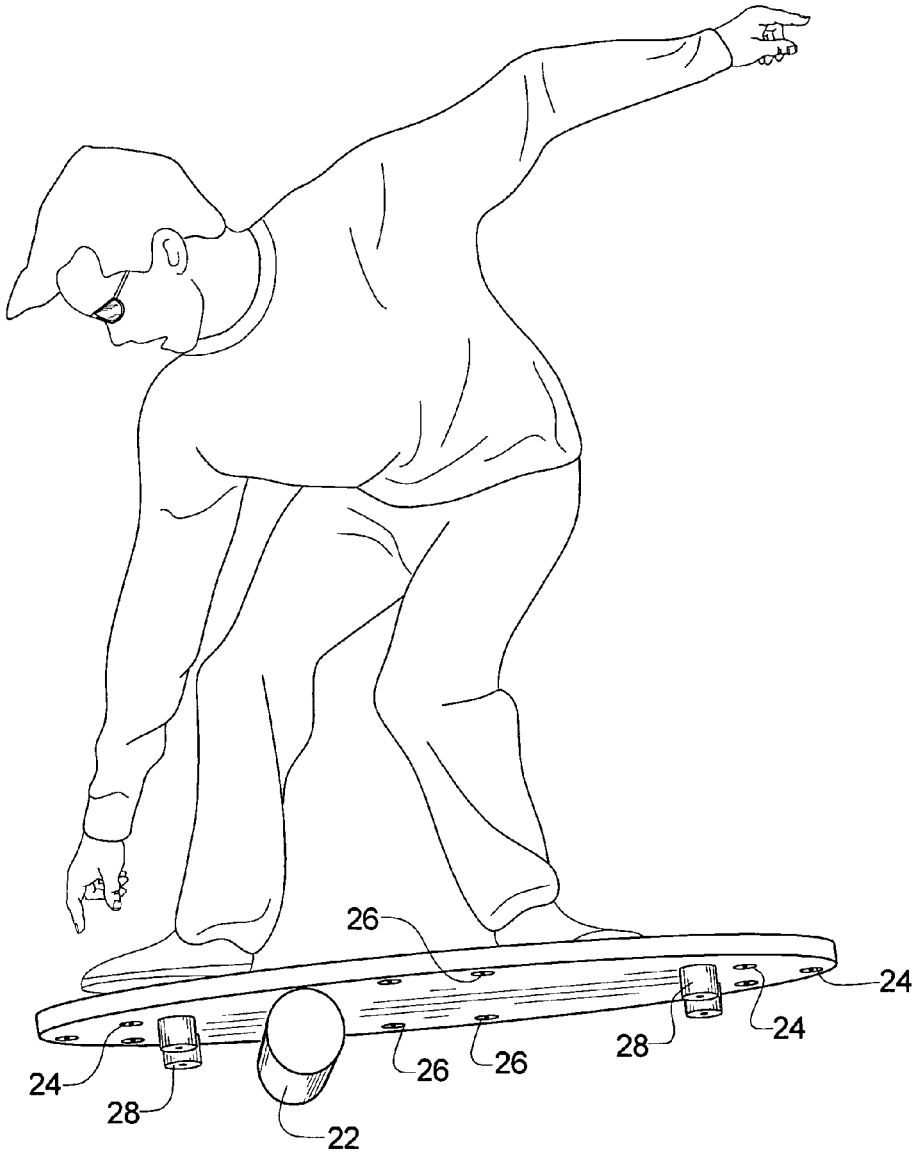
FIG. 4 is an environmental view of the balance board being used for longitudinal travel.

As seen in FIGS. 2 and 4, in order to use the balance board 12 for travel along the roller 22 along the board member's longitudinal axis 18, the stop members 28 are attached to a first pair of attachment points 24. The user stands atop the upper surface 14 of the board member 12 and rides the board member 12 reciprocatively along the longitudinal axis 18. If the distance of the ride is to be either lengthened or shortened, the stop members 28 are moved to a different pair of first attachment points 24 appropriately. If desired, the stop members 28 on one side of the latitudinal axis 20 may be attached to an attachment point 24 that is a distance from the latitudinal axis 20 that is different than the distance of the corresponding other attachment point 24 used by the stop member 28 on the opposite side of the latitudinal axis 20, so that the user has a non-symmetrical back and forth ride with respect to the latitudinal axis 20.

Figure 3:
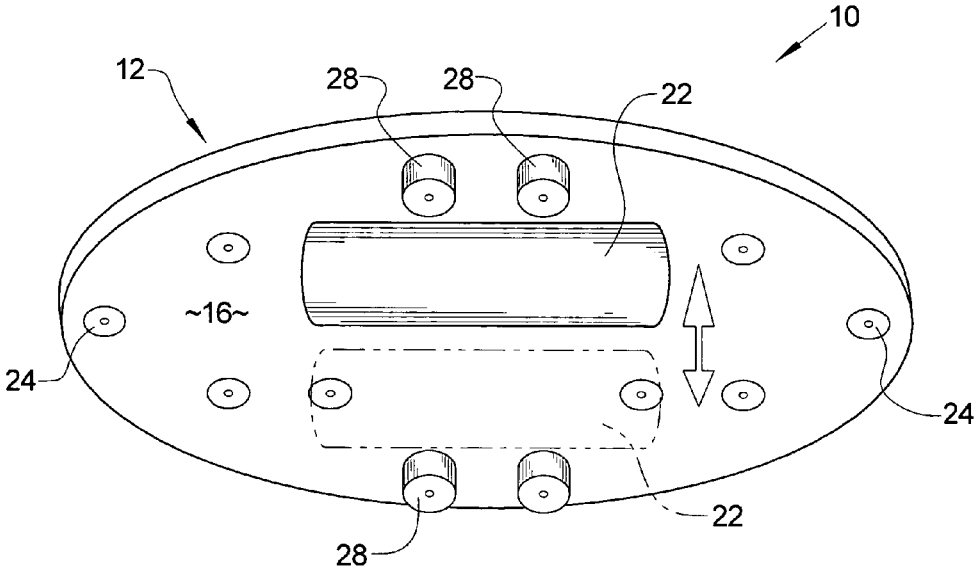
FIG. 3 is a lower perspective view of the balance board of the present invention illustrating the range of travel with respect to a latitudinal axis of travel.
Figure 5:
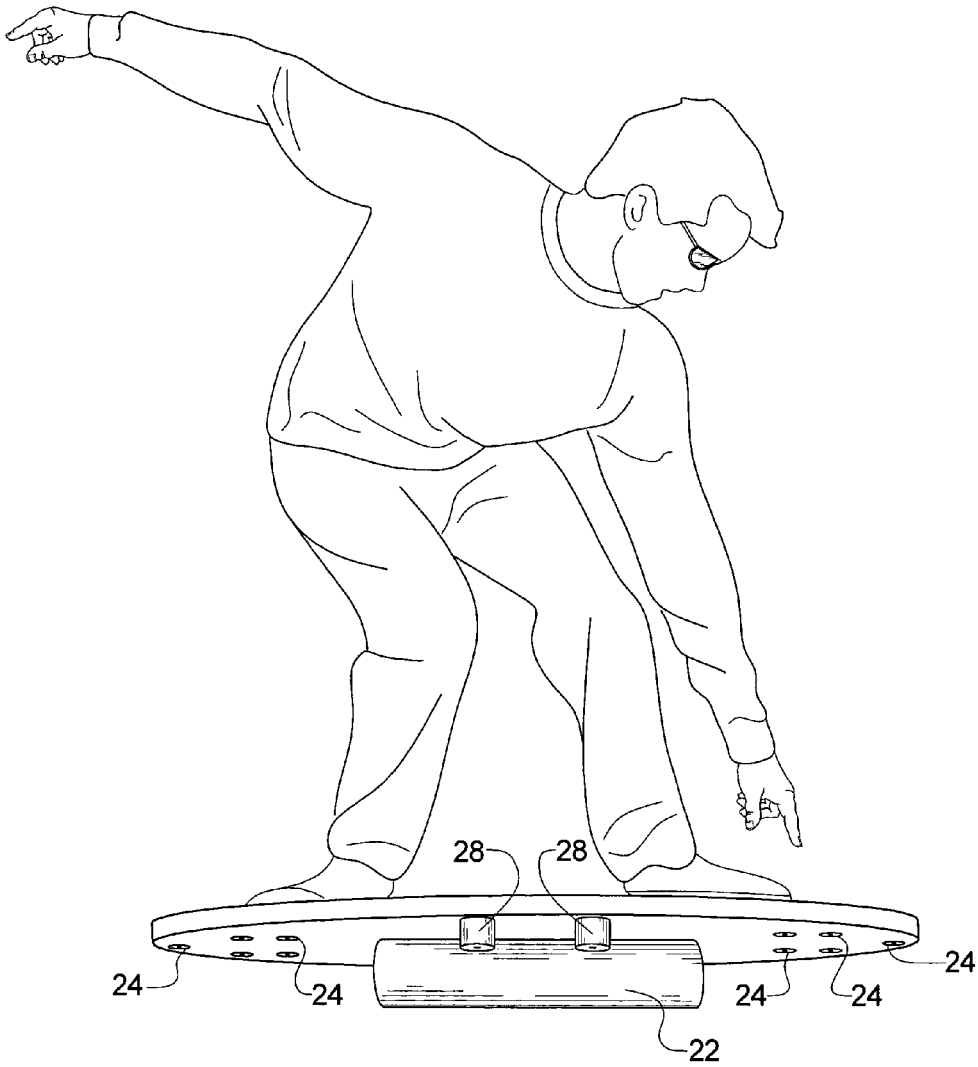
FIG. 5 is an environmental view of the balance board being used for latitudinal travel.

As seen in FIGS. 3 and 5, in order to use the balance board 12 for travel along the roller 22 along the board member's the latitudinal axis 20, the stop members 28 are attached to a second pair of attachment points 26. The user stands atop the upper surface 14 of the board member 12 and rides the board member 12 reciprocatively along the latitudinal axis 20.

Figure 6A:
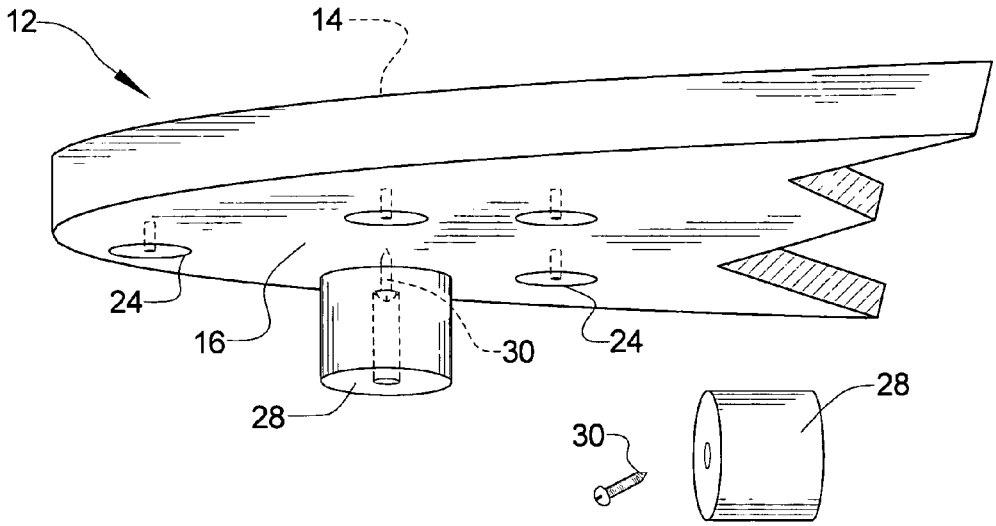
FIGS. 6A–6B illustrate two methods of attachment of the stops to the lower surface of the board member.
Figure 6B:
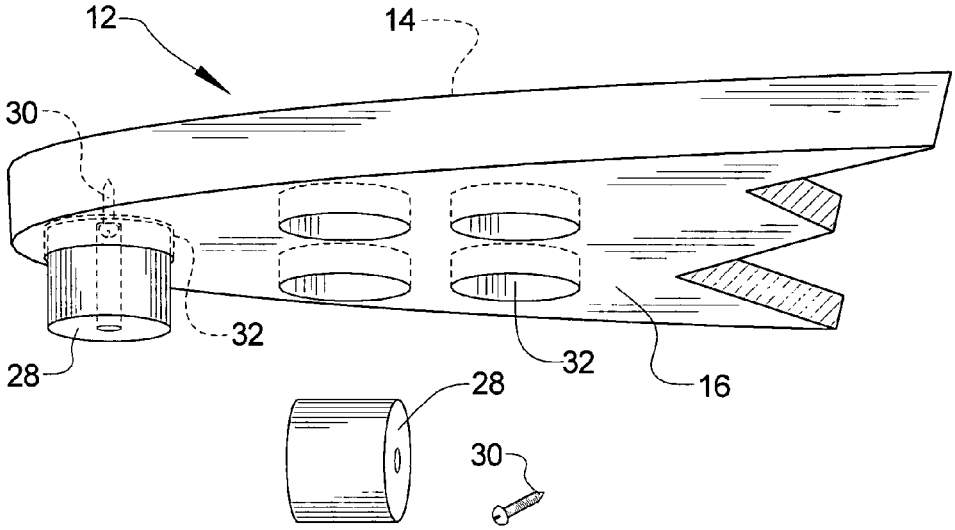

As best seen in FIGS. 6A–6B, the stop members 28 may be attached to the board member 12 in any appropriate fashion, such as by having the stop member 28 abut the lower surface 16 of the board member 12 and having a screw 30 or similar attachment device (bolt and nut, etc.,) pass through the stop member 28 and into the board member 12, as seen in FIG. 6A. Alternately, a recess 32 may be located within the board member 12 at each attachment point 24 and 26, such that the stop member 28 is received within the recess 32 and thereafter the screw 30 passes through the stop member 28 and into the board member 12, as seen in FIG. 6B.

While the invention has been particularly shown and described with reference to an embodiment thereof, it will be appreciated by those skilled in the art that various changes in form and detail may be made without departing from the spirit and scope of the invention.

I claim:

1. A balance board comprising:

a cylindrical roller;

a board member having a lower surface that sits atop the roller and reciprocatively rides on the roller either along a central longitudinal axis or along a central latitudinal axis of the board member a plurality of discrete pairs of openings are located on the lower surface such that each one of the pairs of openings is located equidistant and on opposite sides of the central longitudinal axis and member or the central latitudinal axis of the board member; and a pair of stop members removably attached to the board member for limiting the range of ride of the board member along either the longitudinal axis or the latitudinal axis such that the pair of stop members is attached to the board member at a respective one of the plurality of pairs of openings by passing an attachment fixture through each of the stop members with the fixture being received within the opening.

2. The balance board as in claim 1 wherein the distance between each stop member and the latitudinal axis is variable.

3. The balance board as in claim 1 wherein the stops are attached to the board member on opposed sides of the latitudinal axis in order to limit the ride of the board member along the longitudinal axis and wherein the stops are attached to the board on opposed sides of the longitudinal axis in order to limit the ride of the board member along the latitudinal axis.

4. The balance board as in claim 3 wherein the distance between each stop member and the latitudinal axis is variable.

5. A balance board comprising:

a cylindrical roller;

a board member having a central longitudinal axis and a central latitudinal axis such that the board member that sits atop the roller and reciprocatively rides on the roller either along the central longitudinal axis of the board member or along the central latitudinal axis;

a set of first attachment point pairs located on the board member, each first attachment point being located at equidistant location and on opposing sides of the latitudinal axis with respect to the corresponding other first attachment point;

a set of second attachment point pairs located on the board member, each second attachment point being located at equidistant location and on opposing sides of the longitudinal axis with respect to the corresponding other second attachment point;

a pair of stop members removably attached to the board member at either the first pair of attachment points for limiting the range of ride of the board member along the longitudinal axis or the pair of stops are removably attached to the board member at the second pair of attachment points for limiting the range of ride of the board member along the latitudinal axis;

wherein the set of first attachment point pairs includes multiple first attachment point pairs such that each first attachment point pair is located at a different distance from the latitudinal axis with respect to each other attachment point pair.

6. The balance board as in claim 1 wherein each fixture is a bolt.

7. The balance board as in claim 1 wherein each fixture is a screw.

8. The balance board as in claim 1 wherein each opening is located within a recess.

9. The balance board as in claim 5 wherein each stop of the pair of stops is attached to the balance board by passing an attachment fixture through the stop and receiving the fixture within the respective attachment point.

10. The balance board as in claim 9 wherein each fixture is a bolt.

11. The balance board as in claim 9 wherein each fixture is a screw.

12. The balance board as in claim 5 wherein each attachment point is located within a recess.

13. A balance board comprising:

a cylindrical roller;

a board member that sits atop the roller and reciprocatively rides on the roller either along a central longitudinal axis of the board member or along a central latitudinal axis of the board member;

a pair of stop members removably attached to the board member for limiting the range of ride of the board member along either the longitudinal axis or the latitudinal axis; and wherein the stops are attached to the board member equidistant and on opposed sides of the latitudinal axis in order to limit the ride of the board member along the longitudinal axis; and wherein the stops are attached to the board equidistant and on opposed sides of the longitudinal axis in order to limit the ride of the board member along the latitudinal axis.

14. The balance board as in claim 13 wherein the distance between each stop member and the latitudinal axis is variable.

15. The balance board as in claim 13 wherein the stops are attached to the board member on opposed sides of the latitudinal axis in order to limit the ride of the board member along the longitudinal axis and wherein the stops are attached to the board on opposed sides of the longitudinal axis in order to limit the ride of the board member along the latitudinal axis.

16. The balance board as in claim 13 wherein each stop of the pair of stops is attached to the balance board by passing an attachment fixture through the stop and receiving the fixture within the balance.

17. The balance board as in claim 16 wherein each fixture is a bolt.

18. The balance board as in claim 16 wherein each fixture is a screw.

* * * * *